United States Patent [19]

Jamison

[11] Patent Number: 4,900,159

[45] Date of Patent: Feb. 13, 1990

[54] HIGH SHEAR MIXING APPARATUS

[75] Inventor: Dale E. Jamison, Humble, Tex.

[73] Assignee: NL Industries, Tex.

[21] Appl. No.: 373,625

[22] Filed: Jun. 29, 1989

Related U.S. Application Data

[63] Continuation of Ser. No. 97,859, Sep. 17, 1987, abandoned.

[51] Int. Cl.[4] ..... B01F 7/26

[52] U.S. Cl. ..... 366/343; 366/262; 366/264; 366/315

[58] Field of Search ..... 366/262–266, 366/270, 318, 342, 343, 279, 315–317

[56] References Cited

U.S. PATENT DOCUMENTS

| | | | |
|---|---|---|---|
| 1,756,236 | 4/1930 | Beers | 366/264 X |
| 2,450,802 | 10/1948 | Johnson | 366/264 |
| 2,875,897 | 3/1959 | Booth | 366/264 X |
| 2,985,389 | 5/1961 | Willems | 366/264 X |
| 3,170,638 | 2/1965 | Burton | 366/265 X |
| 3,690,621 | 9/1972 | Tanaka | 366/265 |
| 4,451,155 | 5/1984 | Weber et al. | 366/265 |
| 4,483,624 | 11/1984 | Bacon et al. | 366/263 X |

FOREIGN PATENT DOCUMENTS

| | | | |
|---|---|---|---|
| 703282 | 3/1941 | Fed. Rep. of Germany | 366/265 |
| 655503 | 1/1938 | Fed. Rep. of Germany | 366/262 |
| 1040513 | 10/1958 | Fed. Rep. of Germany | 366/263 |
| 1341441 | 12/1973 | United Kingdom | 366/264 |

*Primary Examiner*—Philip R. Coe
*Assistant Examiner*—Stephen F. Gerrity
*Attorney, Agent, or Firm*—Browning, Bushman, Zamecki & Anderson

[57] ABSTRACT

An apparatus for high shear mixing of material comprising a hub having a rotation axis, a flange attached to the hub and extending radially outwardly therefrom, an impeller operatively attached to the hub for rotation therewith and axially spaced from the flange and an annular skirt attached to the flange, the skirt having a plurality of openings spaced around the circumference, an annular chamber being formed by the hub, the flange, the impeller and the skirt, the impeller having blade formations adapted to pump the materials being mixed into the annular chamber and out through the openings as the apparatus is rotated about the rotation axis.

10 Claims, 1 Drawing Sheet

HIGH SHEAR MIXING APPARATUS

This is a continuation of co-pending U.S application Ser. No. 097,859, filed on Sept. 17, 1987 now abandoned.

BACKGROUND OF THE INVENTION

1. Field of the Invention

The present invention relates to a mixing apparatus and, more particularly, to such an apparatus for high shear mixing of solids and liquids.

2. Description of the Background

The prior art is replete with numerous types of mixing blades or apparatus, some of which are designed specifically to mix solids with liquids under high shear conditions to ensure a uniform mixture. Examples of such prior art mixing blades or apparatus are shown, for example, in U.S. Pat. Nos. 1,756,236: 2,450,802; 2,875,897; and 2,985,389 as well as British Pat. No. 1,341,441. For example, British Pat. No. 341,441 discloses a high shear mixing apparatus which makes use of dual impellers which are separated by a disk and surrounded by a stationary tubular member provided with sets of apertures which are on axially opposite sides of the disk. Mixers, such as that disclosed in the British patent and the U.S. patents referenced above, all utilize rotating and stationary parts in order to achieve high shear mixing.

SUMMARY OF THE INVENTION

It is therefore an object of the present invention to provide an apparatus for the high shear mixing of materials, particularly solids and liquids.

Another object of the present invention is to provide an improved apparatus for high shear mixing which does not use a combination of rotating and stationary components.

The above and other objects of the present invention will become apparent from the drawings, the description given herein and the appended claims.

The high shear mixing apparatus of the present invention includes a central hub having an axis of rotation, a flange operatively attached, and preferably secured, to said hub for rotation therewith, the flange extending radially outwardly from said hub. There is a first impeller, axially spaced from said flange and operatively attached, and preferably secured, to said hub for rotation therewith. An annular skirt having openings therein is operatively attached, and preferably secured to said flange for rotation therewith, the hub, the flange, the skirt and the impeller serving to at least partially form a chamber. The impeller is adapted, when the apparatus is rotated, to force or pump the materials into the chamber and out the openings in the skirt.

DESCRIPTION OF THE PREFERRED EMBODIMENTS

Figure 1:
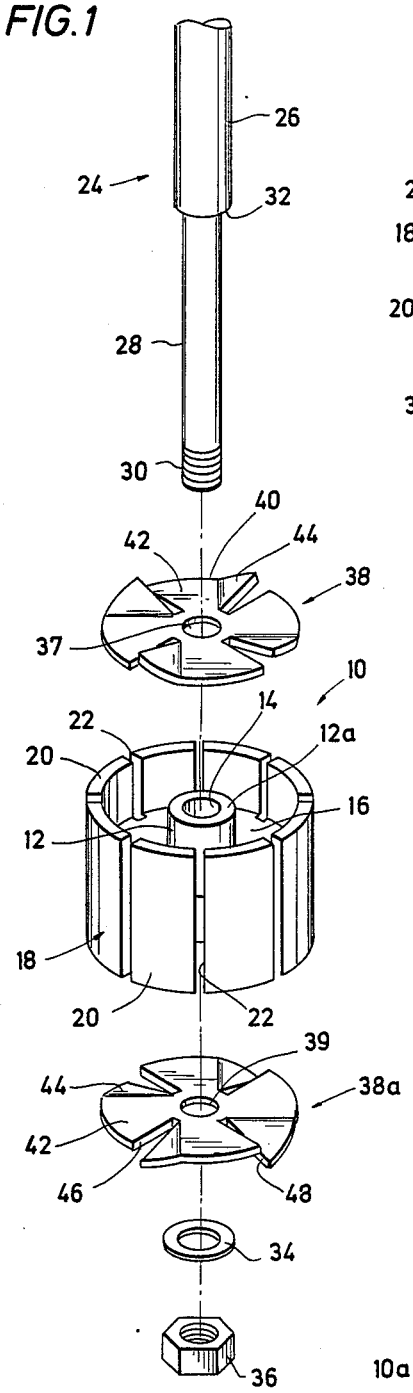
FIG. 1 is an exploded view of the mixing apparatus of the present invention.
Figure 2:
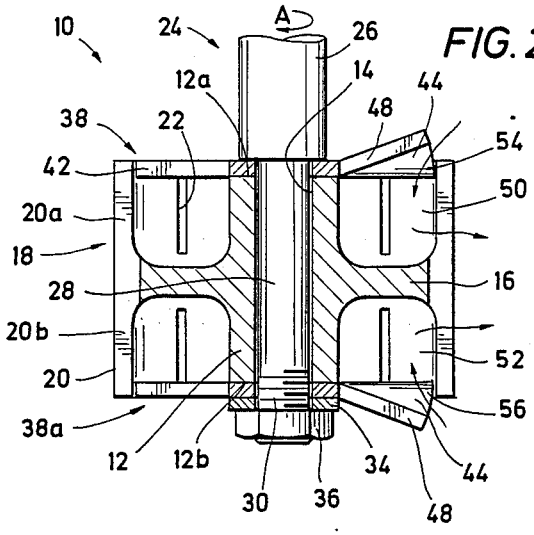
FIG. 2 is an elevational view, partly in section, of the mixing apparatus of the present invention.

Referring first to FIG. 1, the mixing apparatus shown generally as 10 includes a central hub 12 having a bore 14 extending axially thereto, bore 14 defining an axis of rotation extending through hub 12. Attached to and extending radially outwardly from hub 12 is a circular flange 16, flange 16, as best seen in FIG. 2, being formed integrally with hub 12. An annular skirt, shown generally as 18, is attached to flange 16, annular skirt 18 being made up of a series of axially extending segments 20 which are formed integrally with flange 16 and which are separated by axially extending slots 22, segments 20 having first and second portions 20*a* and 20*b* which extend axially in opposite directions from flange 16.

A shaft, shown generally as 24, has a large diameter portion 26 which is operatively attached to a motor or the like (not shown) to effect rotation of shaft 24, and a reduced diameter portion 28 having a threaded end 30, a shoulder 32 being formed at the point of juncture of portions 26 and 28 of shaft 24. As best seen in FIG. 2, reduced diameter portion 28 of shaft 24 is received in bore 14 of hub 12, the threaded end portion 30 extending through hub 12 and being engaged by a washer 34 and a nut 36 to secure shaft 24 to mixing apparatus 10

A first impeller, shown generally as 38, and having a central bore 37, is received between one end 12*a* of hub 12 and shoulder 32 on shaft 24, the portion 28 extending through bore 37, impeller 38 being axially spaced from flange 16. A second impeller 38*a*, having a central bore 39, is received between a second end 12*b* of hub 12 and washer 34, the end 30 of shaft 24 extending through bore 39. Impeller 38*a* is on the opposite side of flange 16 from impeller 31 and, like impeller 38, is axially spaced from flange 16. It will thus be seen that when nut 36 is tightened onto shaft 24 hub 12 and first and second impellers 38 and 38*a* are compressively locked to shaft 24 and rotate therewith, meaning that flange 16 and skirt 18 also rotate with shaft 24.

Each of the impellers 38, 38*a* comprise a plurality of generally pie-shaped blades 40 each blade 40 having a first portion 42 which is generally planar and lies in a plane which is generally parallel to a plane passing through flange 16 generally normal to the rotation axis of hub 12. Each of the blades 40 also has a second portion 44 which has a generally axially and radial outward pitch relative to first portion 42. In the preferred case, impellers 38, 38*a* have four such, equally spaced blades With particular reference to FIG. 1, it can be seen that first portion 42 forms a trailing edge 46 while second portion 44 forms a leading edge 48.

Referring now to FIG. 2, it can be seen that a first, annular chamber 50 is at least partially defined by hub 12, flange 16, portion 20*a* of skirt 18 and first impeller 38, while a second annular chamber 52 is at least partially formed by hub 12, flange 16, second portion 20*b* of skirt 18 and second impeller 38*a*. It will also be apparent that the leading edge 48 and the trailing edge 46 of adjacent blades on each of said impellers 38 or 38*a* cooperatively define intake apertures 54, 56, respectively, into chambers 50 and 52, respectively, four such apertures being formed by each impeller.

In operation, and with shaft 24 rotating in the direction shown by arrow A, material would be forced or pumped into chambers 50 and 52 through intake apertures 54 and 56, respectively, by means of second portions 44 of impellers 38 and 38*a* which would, in effect, act as scoops as the apparatus 10 was rotated through the materials being mixed. The materials in chambers 50 and 52 would then be forced radially outwardly, under high shear, through slots 22 back into the bulk of materials being mixed.

Figure 3:
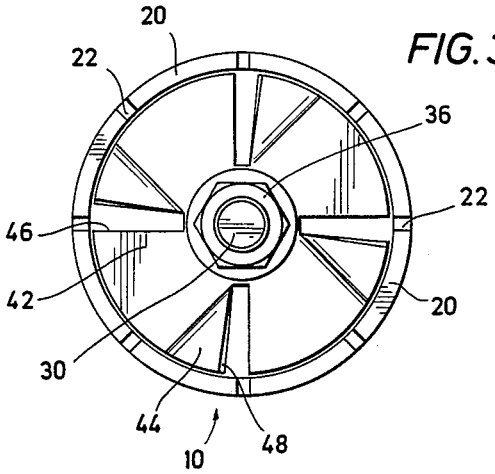
FIG. 3 is a bottom, planar view of the mixing apparatus shown in FIG. 2.
Figure 4:
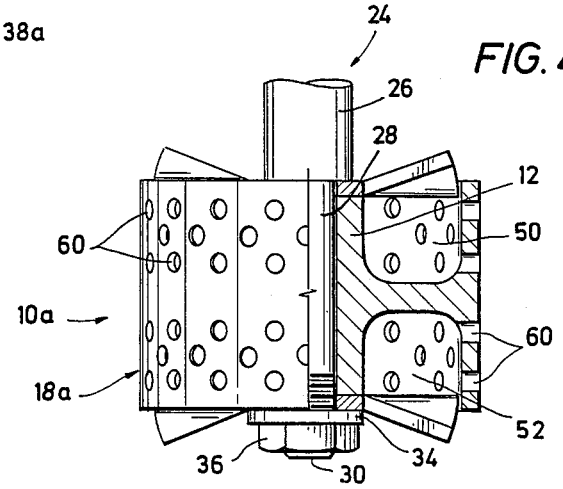
FIG. 4 is a view, similar to FIG. 2, showing another embodiment of the mixing apparatus of the present invention.

Referring now to FIG. 4, there is shown a slightly modified embodiment wherein skirt 18*a*, instead of having slots such as slots 22, has a plurality of generally symmetrically displaced circular holes 60 about the circumference of skirt 18*a*. In essence, skirt 18*a* is identical to skirt 18 with the exception that skirt 18*a* is formed with circular hole 60 rather than slots 22. Material forced into the chambers 50 and 52 in the mixing apparatus 10*a* shown in FIG. 4 is forced radially outwardly through the hole 60 under high shear, holes 60 serving essentially the same purposes as slots 22 of the embodiment of the mixing apparatus shown in FIGS. 1–3. It should be apparent from the foregoing discussion and from FIGS. 1, 2 and 4 that the skirt of the mixing device according to the present invention has a solid or fluid-barrier perimeter surface area substantially greater than the perimeter surface area of the slots, holes or other fluid passageways through the skirt.

While the invention has been described with reference to the formation of two chambers 50 and 52, and two impellers, e.g. 38 and 38*a*, it will be apparent that the mixing apparatus can be formed with a single chamber, e.g. chamber 50, and a single impeller, e.g., impeller 38, simply by the elimination of the second portion 20*b* of the skirt 20 and second impeller 38*a*. However, for more efficient mixing, it is desirable that the mixing apparatus be formed with dual, axially displaced annular chambers 50 and 52.

It will be appreciated that the impellers 38, 38*a* can take many forms, the only requisite being that the impeller be of a type which forces or pumps the materials being mixed generally axially inwardly into the chambers 50, 52, if there are dual chambers Thus, it is not necessary that the impellers 38, 38*a* have four blades or that the blades have the configuration shown. It is, however, necessary that the impellers be of a type which exert a generally continuously, axially inward pumping action into the chamber 50, 52, such that any materials in the annular chambers will be forced generally radially outwardly through the openings formed in the annular skirt. Thus, any impellers of a type which have scoops or the like which collect and force the materials to be mixed generally axially into the annular chambers as the mixing apparatus is rotated are suitable. Also, impellers which have a more conventional propeller configuration will function.

While in the embodiment shown, the hub, flange and skirt portion are shown as a monolithic structure, it will be apparent that such is not necessary. It is only necessary that the annular skirt together with the flange and the impeller be operatively connected so as to rotate together with shaft 24.

An efficient, high shear mixing apparatus can also be constructed utilizing dual impellers, such as 38, 38*a*, together with skirt 18 but with flange 16 eliminated to the extent that skirt 18 is supported by a series of spokes radiating out from hub 12 rather than by a continuous flange such as flange 16. Accordingly, there would then be formed a single mixing chamber comprised of combined chambers 50, 2 since those chambers would be in open communication with one another and would not be separated by a flange, such as flange 16. Since the impellers are designed and rotated in such a manner that impeller 38 pumps axially downward (with reference to FIG. 2) and impeller 38*a* pumps axially upward (with reference to FIG. 2), the materials being mixed would be forced axially into the combined chamber 50, 52 through both the upper and lower ends (again with reference to FIG. 2), respectively, and forced radially outwardly through the opening in the skirt 18. Moreover, flange 16 could be made of perforate structure with holes therethrough permitting communication between chambers 50 and 52 with fundamentally the same action. It will thus be seen that a mixing apparatus can be comprised of dual impellers, axially spaced from one another, the impellers being operatively attached to the hub for rotation therewith, and an annular skirt operatively attached to the flange for rotation therewith, the skirt having at least one radial opening, the skirt, the hub and the dual impellers forming an annular chamber disposed between the two impellers such that the dual impellers force or pump materials into the annular chamber and out through the opening when the apparatus is rotated about the axis of rotation of the hub.

The mixing apparatus of the present invention is particularly useful for dispensing solids in a liquid. The mixing apparatus of the present invention requires no seals. Additionally, the mixing apparatus can be easily disassembled for cleaning purposes if necessary.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. An apparatus for high shear mixing of materials comprising:

a hub having a rotation axis;

a flange operatively attached to said hub for rotation therewith and extending radially outwardly from said hub;

a first impeller means operatively attached to said hub for rotation therewith and axially spaced from said flange;

an annular skirt operatively attached to said flange for rotation therewith said skirt having a fluid-barrier perimeter surface area said skirt having a plurality of openings therethrough defining a second perimeter surface area, the second perimeter surface area being substantially less than the fluid-barrier perimeter surface area, said hub, said flange, said first impeller means and said skirt at least partially defining a first annular chamber, said first impeller means having blade means adapted to force said materials into said first annular chamber and out through one or more first openings of said plurality of openings when said apparatus is rotated about said rotation axis;

a second impeller means operatively attached to said hub for rotation therewith, said second impeller means being axially spaced from said flange and on the opposite side of said flange from said first impeller means;

the annular skirt having a first axially extending portion extending from said flange toward said first impeller means and a second, axially extending portion extending from said flange toward said second impeller means, each of said first and second portions of said annular skirt having at least one of said plurality of openings, said first annular chamber being at least partially defined by said hub, said flange, said first portion of said skirt and said first impeller means;

said hub, said flange, said second impeller means and said second portion of said skirt defining a second annular chamber axially spaced from said first annular chamber, said second impeller means having blade means adapted to force said materials into said second annular chamber and out through one or more second openings of said plurality of openings when said apparatus is rotated about said rotational axis; and said flange at least substantially prohibiting fluid communication between said first annular chamber and said second annular chamber to increase efficiency of mixing of materials.

2. The apparatus of claim 1 wherein said skirt has a plurality of said openings spaced around the circumference of said skirt.

3. The apparatus of claim 2 wherein said openings comprise a plurality of generally axially extending slots, said slots being generally equally spaced around the circumference of said skirt.

4. The apparatus of claim 2 wherein said openings comprise a plurality of generally circular holes, said holes being generally symmetrically spaced around the circumference of said skirt.

5. The apparatus of claim 1 wherein said hub includes means to attach said mixing apparatus to a rotatable shaft.

6. The apparatus of claim 1 wherein there are a plurality of openings in each of said first and second skirt portions.

7. The apparatus of claim 6 wherein said openings comprise a plurality of generally axially extending slots, said slots being generally equally spaced around the circumference of said skirt portion.

8. The apparatus of claim 6 wherein said openings comprise generally circular holes, said holes being generally symmetrically spaced around the circumference of said skirt portion.

9. The apparatus of claim 1 wherein each of said first and second impeller means has a plurality of equally spaced blades, each of said blades having a first portion which is generally parallel to said flange and defining a trailing edge of said blade and a second portion having a generally axially and radially outward pitch relative to said first portion and defining a leading edge, the leading edge of one of said blades and the trailing edge of an adjacent of said blades on one of said impellers defining an intake aperture into a respective one of said annular chambers.

10. The apparatus of claim 9 wherein said first and second impeller means comprises four of said blades.

* * * * *